US008067730B2

(12) United States Patent
Vertes et al.

(10) Patent No.: US 8,067,730 B2
(45) **Date of Patent: *Nov. 29, 2011**

(54) LASER ABLATION ELECTROSPRAY IONIZATION (LAESI) FOR ATMOSPHERIC PRESSURE, IN VIVO, AND IMAGING MASS SPECTROMETRY

(75) Inventors: Akos Vertes, Reston, VA (US); Peter Nemes, Silver Spring, MD (US)

(73) Assignee: The George Washington University, Washington, DC (US)

( * ) Notice: Subject to any disclaimer, the term of this patent is extended or adjusted under 35 U.S.C. 154(b) by 456 days.

This patent is subject to a terminal disclaimer.

(21) Appl. No.: 12/176,324

(22) Filed: Jul. 18, 2008

(65) Prior Publication Data

US 2009/0272892 A1 Nov. 5, 2009

Related U.S. Application Data

(60) Provisional application No. 60/951,186, filed on Jul. 20, 2007.

(51) Int. Cl.
*H01J 49/26* (2006.01)

(52) U.S. Cl. ..... 250/288; 250/281; 250/282

(58) Field of Classification Search ..... 250/281, 250/282, 288

See application file for complete search history.

(56) References Cited

U.S. PATENT DOCUMENTS

| | | | |
|---|---|---|---|
| 5,965,884 | A | 10/1999 | Laiko et al. |
| 6,656,690 | B2 | 12/2003 | Crooke et al. |
| 6,744,046 | B2 | 6/2004 | Valaskovic et al. |
| 6,949,741 | B2 | 9/2005 | Cody et al. |
| 6,991,903 | B2 | 1/2006 | Fu et al. |
| 7,084,396 | B2 | 8/2006 | Schneider |
| 7,091,483 | B2 | 8/2006 | Fischer et al. |
| 7,112,785 | B2 | 9/2006 | Laramee et al. |
| 7,129,483 | B2 | 10/2006 | Youngquist et al. |
| 7,170,052 | B2 | 1/2007 | Furutani et al. |
| 7,335,897 | B2 | 2/2008 | Takats et al. |
| 7,629,576 | B2 | 12/2009 | Schultz et al. |
| 7,687,772 | B2 | 3/2010 | Shiea et al. |
| 7,714,276 | B2 | 5/2010 | Pevsner et al. |
| 2002/0190203 | A1 * | 12/2002 | Valaskovic et al. ..... 250/288 |
| 2005/0029444 | A1 | 2/2005 | Caprioli |
| 2005/0230635 | A1 | 10/2005 | Takats et al. |
| 2005/0247871 | A1 | 11/2005 | Bryden et al. |
| 2007/0176113 | A1 | 8/2007 | Shiea et al. |
| 2008/0020474 | A1 | 1/2008 | Hayashizaki et al. |

(Continued)

FOREIGN PATENT DOCUMENTS

| | | | |
|---|---|---|---|
| WO | WO 96/32504 | A2 | 10/1996 |

(Continued)

OTHER PUBLICATIONS

Huang et al., "Direct Protein Detection from Biological Media through Electrospray-Assisted Laser Desportion Ionization/Mass Spectrometry", Journal of Proteome Research, 2006, 5, pp. 1107-1116.*

(Continued)

*Primary Examiner* — Robert Kim
*Assistant Examiner* — Nicole Ippolito Rausch
(74) *Attorney, Agent, or Firm* — K&L Gates LLP

(57) ABSTRACT

The field of the invention is atmospheric pressure mass spectrometry (MS), and more specifically a process and apparatus which combine infrared laser ablation (LA) with electrospray ionization (ESI).

5 Claims, 10 Drawing Sheets

U.S. PATENT DOCUMENTS

| | | | | |
|---|---|---|---|---|
| 2008/0116366 | A1* | 5/2008 | Shiea et al. | 250/282 |
| 2008/0128614 | A1 | 6/2008 | Nikolaev et al. | |
| 2008/0149822 | A1 | 6/2008 | Vertes et al. | |
| 2008/0308722 | A1 | 12/2008 | Shiea | |
| 2009/0027892 | A1 | 1/2009 | Bremerich et al. | |
| 2009/0261243 | A1 | 10/2009 | Bamberger et al. | |
| 2009/0272893 | A1 | 11/2009 | Hieftje et al. | |
| 2009/0321626 | A1 | 12/2009 | Vertes et al. | |
| 2010/0012831 | A1 | 1/2010 | Vertes et al. | |
| 2010/0090101 | A1 | 4/2010 | Schultz et al. | |
| 2010/0090105 | A1 | 4/2010 | Liang et al. | |
| 2010/0285446 | A1 | 11/2010 | Vertes et al. | |

FOREIGN PATENT DOCUMENTS

| | | | |
|---|---|---|---|
| WO | WO 99/45150 | A1 | 9/1999 |
| WO | WO 00/52455 | A1 | 9/2000 |
| WO | WO 00/77821 | | 12/2000 |
| WO | WO 01/25486 | A1 | 4/2001 |
| WO | WO 02/055189 | A2 | 7/2002 |
| WO | WO 02/070664 | A2 | 9/2002 |
| WO | WO 02/071066 | A1 | 9/2002 |
| WO | WO 02/095362 | | 11/2002 |
| WO | WO 03/093817 | A2 | 11/2003 |
| WO | WO 03/100035 | A2 | 12/2003 |
| WO | WO 2004/013602 | | 2/2004 |
| WO | WO 2004/044554 | A2 | 5/2004 |
| WO | WO 2004/044555 | A2 | 5/2004 |
| WO | WO 2004/076612 | A2 | 9/2004 |
| WO | WO 2004/088271 | | 10/2004 |
| WO | WO 2004/097427 | A1 | 11/2004 |
| WO | WO 2005/024046 | A2 | 3/2005 |
| WO | WO 2005/031304 | A2 | 4/2005 |
| WO | WO 2005/033271 | A2 | 4/2005 |
| WO | WO 2006/014984 | | 2/2006 |
| WO | WO 2006/023398 | A2 | 3/2006 |
| WO | WO 2006/026020 | | 3/2006 |
| WO | WO 2006/048642 | A2 | 5/2006 |
| WO | WO 2006/054101 | A2 | 5/2006 |
| WO | WO 2006/059123 | A2 | 6/2006 |
| WO | WO 2006/061593 | A2 | 6/2006 |
| WO | WO 2006/061625 | A2 | 6/2006 |
| WO | WO 2006/064274 | A2 | 6/2006 |
| WO | WO 2006/064280 | A2 | 6/2006 |
| WO | WO 2006/067495 | A2 | 6/2006 |
| WO | WO 2006/085110 | A2 | 8/2006 |
| WO | WO 2006/129094 | A2 | 12/2006 |
| WO | WO 2007/052025 | A2 | 5/2007 |

OTHER PUBLICATIONS

U.S. Appl. No. 11/795,687, filed Jul. 20, 2007, George Washington University.

U.S. Appl. No. 11/674,671, filed Feb. 14, 2007, George Washington University.

U.S. Appl. No. 61/145,544, filed Jan. 17, 2009, George Washington University.

U.S. Appl. No. 61/167,442, filed Apr. 8, 2009, George Washington University.

U.S. Appl. No. 12/176,324, filed Jul. 18, 2008, George Washington University.

Huang, Min-Zong, et. al., Direct Protein Detection from Biological Media through Electrospray Assisted Laser Desorption Ionization/Mass Spectrometry, Journal of Proteome Research, vol. 5, No. 5, 2006, pp. 1107-1116.

Takats, Zoltan, et. al., Mass Spectrometry Sampling Under Ambient Conditions with Desorption Electrospray Ionization, Science Magazine, vol. 306, Oct. 15, 2004, pp. 471-473.

Cody, Robert B., et. al., Versatile New Ion Source for the Analysis of Materials in Open Air under Ambient Conditions, Analytical Chemistry, vol. 77, No. 8, Apr. 15, 2005, pp. 2297-2302.

Zoltan Takats et al "Mass Spectrometry Sampling Under Ambient Conditions with Desorption Electrospray Ionization" Science, Oct. 15, 2004, vol. 306, pp. 471-473.

Min-Zong Huang et al "Direct Protein Detection from Biological Media through Electrospray-Assisted Laser Desorption Ionization/Mass Spectrometry" Journal of Proteome Research, 2006, vol. 5, No. 5, pp. 1107-1116.

Robert B. Cody et al "Versatile New Ion Source for the Analysis of Materials in Open Air under Ambient Conditions" Analytical Chemistry, Apr. 15, 2005, vol. 77, No. 8, pp. 2297-2302.

Nemes, Peter and Akos Vertes, "Laser Ablation Electrospray Ionization for Atmospheric Pressure, in Vivo and Imaging Mass Spectromerty", Analytical Chemistry, Nov. 1, 2007, vol. 79, No. 21, American Chemical Society, published on Web Sep. 27, 2007, pp. 8098-8106.

Stockle et al., Nanoscale Atmospheric Pressure Laser Ablation-Mass Spectrometry, Analytical Chemistry, 2001, vol. 73, No. 7, pp. 1399-1402.

Coon et al., Laser-Desorption-Atmospheric Pressure Checmical Ionization Mass Spectrometry for the Analysis of Peptides from Aqueous Solution Analytical Chemistry, Nov. 1, 2002, vol. 74, No. 21, pp. 5600-5605.

Rasmussen et al., New Dimension in Nano-Imaging: Breaking Through the Diffraction Limit with Scanning Near-Field Optical Microscopy, Anal Bioanal Chem, 2005, vol. 381, pp. 165-172.

Takubo Kenji, Ionizing Device and Mass Spectrometer Using the Same, Apr. 14, 2005.

* cited by examiner

LASER ABLATION ELECTROSPRAY IONIZATION (LAESI) FOR ATMOSPHERIC PRESSURE, IN VIVO, AND IMAGING MASS SPECTROMETRY

RELATED APPLICATION INFORMATION

This application claims priority benefit under 35 U.S.C. 119(e) to U.S. 60/951,186, filed 20 Jul. 2007, the contents of which are incorporated herein in their entirety.

STATEMENT OF GOVERNMENTAL INTEREST

The U.S. Government has an interest in this invention by virtue of a grant from the National Science Foundation (Grant #s 0415521 and 0719232) and a grant from the Department of Energy (Grant # DEFG02-01ER15129).

FIELD OF THE INVENTION

The field of the invention is atmospheric pressure mass spectrometry (MS), and more specifically a process and apparatus which combine infrared laser ablation with electrospray ionization (ESI).

BACKGROUND

Mass spectrometry (MS) plays a major role in chemical, biological and geological research. Proteomic, glycomic, lipidomic and metabolomic studies would be impossible without modern mass spectrometry. Owing to their high sensitivity and exceptional specificity, mass spectrometric methods also appear to be ideal tools for in vivo analysis in the life sciences. In many of these applications, however, the samples must be preserved in their native environment with preferably no or minimal interference from the analysis. For most of the traditional ion sources applied in the biomedical field, such as matrix-assisted laser desorption ionization (MALDI) or electrospray ionization (ESI), these limitations present serious obstacles. For example, MALDI with ultraviolet laser excitation requires the introduction of an external, often denaturing, matrix, whereas ESI calls for liquid samples with moderate ionic conductivity. As living organisms are typically disrupted by such preparations, there is a great interest in developing direct sampling and ambient ionization sources for in vivo studies.

Rapid advances in recent years have provided a growing number of ambient ion sources. For example, atmospheric pressure infrared MALDI (AP IR-MALDI), capable of producing ions from small and moderate size molecules (up to 3,000 Da), shows promise for metabolic imaging. Small molecules have been analyzed by other methods, including direct analysis in real time (DART), desorption electrospray ionization (DESI), desorption atmospheric pressure chemical ionization (DAPCI) and matrix-assisted laser desorption electrospray ionization (MALDESI). Medium to large biomolecules have also been detected by DESI and on dehydrated samples by electrospray laser desorption ionization (ELDI). Imaging capabilities were demonstrated for DESI on a rat brain tissue section with about 400 μm lateral resolution. Due to the need for sample pretreatment, sensitivity to surface properties (DESI, DART, DAPCI and AP IR-MALDI) and external matrix (ELDI and MALDESI), in vivo capabilities are very limited for these techniques.

An awkward feature of mass spectrometry (MS) is the requirement of a vacuum system. Analysis under ambient conditions would simplify and expand the utility of mass spectrometry.

Takats et al. report a method of desorption electrospray ionization (DESI) whereby an aqueous spray of electrosprayed charged droplets and ions of solvent are directed at an analyte which has been deposited on an insulating surface. The microdroplets from the aqueous spray produce ions from the surface whereby the desorbed ions are directed into a mass spectrometer for analysis. A broad spectrum of analytes was examined, including amino acids, drugs, peptides, proteins, and chemical warfare agents.

Cody et al. report a method they called "DART" wherein helium or nitrogen gas is sent through a multi-chambered tube wherein the gas is i) subjected to an electrical potential, ii) ions are removed from the gas stream, iii) the gas flow is heated, and then iv) the gas is directed at a mass spectrometer ion collection opening. They report that subjecting hundreds of different chemicals to this technique provided a very sensitive method for detecting chemicals, including chemical warfare agents and their signatures, pharmaceuticals, metabolites, peptides, oligosaccharides, synthetic organics and organometallics, drugs, explosives, and toxic chemicals. Further, they report that these chemicals were detected on a wide variety of substrates including concrete, asphalt, skin, currency, airline boarding passes, business cards, fruit, vegetables, spices, beverages, bodily fluids, plastics, plant leaves, glassware, and clothing.

Shiea et al. report the development of a method called electrospray-assisted laser desorption ionization (ELDI). They report that DESI-MS is limited in that it cannot analyze complex mixtures and there is very little control over the size and definition of the surface area affected by the ESI plume for the desorption of the analyte. They also acknowledge the problem that direct laser desorption is limited to low molecular weight compounds and that lasers desorb more neutrals than ions. Accordingly, they report a combination of ESI and ultraviolet laser desorption (LD) wherein i) a sample is irradiated with a pulsed nitrogen laser beam to generate laser desorbed material, ii) this material is then ionized by subjecting it to an electrospray plume, and iii) the ions sent to a mass spectrometer. This technique is reported to provide sensitivity towards protein detection without sample prep or the use of a matrix. However, their experimental setup shows a stainless steel sample plate upon which aqueous solution of protein was spread and the sample dried. The method was ultimately presented for the analysis of solid samples.

Atmospheric pressure laser desorption techniques such as atmospheric pressure matrix-assisted laser desorption ionization (AP-MALDI) or electrospray-assisted laser desorption ionization (ELDI) usually require the pretreatment of the sample with a suitable matrix.

Further, it has been difficult previously to study the spatial distribution of chemicals at atmospheric pressure using MS.

Lastly, other matrixless methods do not achieve ESI-like ionization. Thus, with other matrixless methods (e.g., DIOS) large molecules cannot be detected as multiply charged species.

The following documents may provide additional context where necessary for fuller understanding of the claimed invention and are incorporated by reference herein in their entirety for references purposes and for determining the level of ordinary skill in the art:

U.S. Pat. Nos. 6,949,741 and 7,112,785 by Cody et al.

U.S. Pat. No. 5,965,884 by Laiko et al.;

Publication on DESI: "Mass Spectrometry Sampling Under Ambient Conditions with Desorption Electrospray Ionization," Z. Takats; J. M. Wiseman; B. Gologan; and R. G.

Cooks, Science 2004, 306, 471-473;

Publication on ELDI: "Direct Protein Detection from Biological Media through Electrospray-Assisted Laser Desorption Ionization/Mass Spectrometry," M.-Z. Huang; H.-J. Hsu; J.-Y. Lee; J. Jeng; J. Shiea, J. Proteome Res. 2006, 5, 1107-1116; and Publication on DART: "Versatile New Ion Source for the Analysis of Materials in Open Air under Ambient Conditions," R. B. Cody; J. A. Laramee; and D. Durst, Anal. Chem. 2005, 77, 2297-2302.

SUMMARY

Mass spectrometric analysis of biomolecules under ambient conditions promises to enable the in vivo investigation of diverse biochemical changes in organisms with high specificity. Here we report on a novel combination of infrared laser ablation with electrospray ionization (LAESI) as an ambient ion source for mass spectrometry. As a result of the interactions between the ablation plume and the spray, LAESI accomplishes electrospray-like ionization. Without any sample preparation or pretreatment, this technique was capable of detecting a variety of molecular classes and size ranges (up to 66 kDa) with a detection limit of ~100 fmol/sample (~0.1 fmol/ablated spot) and quantitation capability with a four-decade dynamic range. We demonstrated the utility of LAESI in a broad variety of applications ranging from plant biology to clinical analysis. Proteins, lipids and metabolites were identified, and the pharmacokinetics of antihistamine excretion was followed via the direct analysis of bodily fluids (urine, blood and serum). We also performed in vivo spatial profiling (on leaf, stem and root) of metabolites in a French marigold (*Tagetes patula*) seedling.

In one preferred embodiment, a process and apparatus which combine infrared laser ablation with electrospray ionization (ESI). This allows a sample to be directly analyzed 1) without special preparation and 2) under ambient conditions. The samples which can be analyzed using this process include pharmaceuticals, dyes, explosives, narcotics, polymers, tissue samples, and biomolecules as large as albumin (BSA) (66 kDa).

In general terms, the invention starts with using a focused IR laser beam to irradiate a sample thus ablating a plume of ions and particulates. This plume is then intercepted with charged electrospray droplets. From the interaction of the laser ablation plume and the electrospray droplets, gas phase ions are produced that are detected by a mass spectrometer.d is performed at atmospheric pressure.

Another preferred embodiment provides an ambient ionization process, which comprises: i) irradiating a sample with an infrared laser to ablate the sample; ii) intercepting this ablation plume with an electrospray to form gas-phase ions; and iii) analyzing the produced ions using mass spectrometry. In this embodiment, the ample is optionally directly analyzed without any chemical preparation and under ambient conditions, and/or the sample is optionally selected from the group consisting of pharmaceuticals, metabolites, dyes, explosives, narcotics, polymers, tissue samples, and large biomolecules, chemical warfare agents and their signatures, peptides, oligosaccharides, proteins, synthetic organics, drugs, explosives, and toxic chemicals.

In another preferred embodiment a LAESI-MS device is provided, comprising: i) a pulsed infrared laser for emitting energy at a sample; ii) an electrospray apparatus for producing a spray of charged droplets; and, iii) a mass spectrometer having an ion transfer inlet for capturing the produced ions. In this embodiment, the sample is optionally directly analyzed without special preparation and under ambient conditions, and/or the sample is selected from the group consisting of pharmaceuticals, metabolites, dyes, explosives, narcotics, polymers, tissue samples, and biomolecules as large as albumin (BSA)(66 kDA), chemical warfare agents and their signatures, peptides, oligosaccharides, proteins, synthetic organics, drugs, explosives, and toxic chemicals.

A preferred embodiment provides a method of directly detecting the components of a sample, comprising: subjecting a sample to infrared LAESI mass spectrometry, wherein the sample is selected from the group consisting of pharmaceuticals, dyes, explosives, narcotics, polymers, tissue samples, and biomolecules, and wherein the LAESI-MS is performed using a LAESI-MS device directly on a sample wherein the sample does not require conventional MS pretreatment and is performed at atmospheric pressure.

DETAILED DESCRIPTION

Referring now to the figures, whereas atmospheric pressure laser desorption techniques such as atmospheric pressure matrix-assisted laser desorption ionization (AP-MALDI) or electrospray-assisted laser desorption ionization (ELDI) usually require the pretreatment of the sample with a suitable matrix, the present method which does not involve pretreatment of samples at all. As shown herein, the samples can successfully be analyzed directly or can be presented on surfaces such as glass, paper or plastic, or substrates described supra, etc. This offers convenience and yields high throughput during the analysis.

Figure 4A:
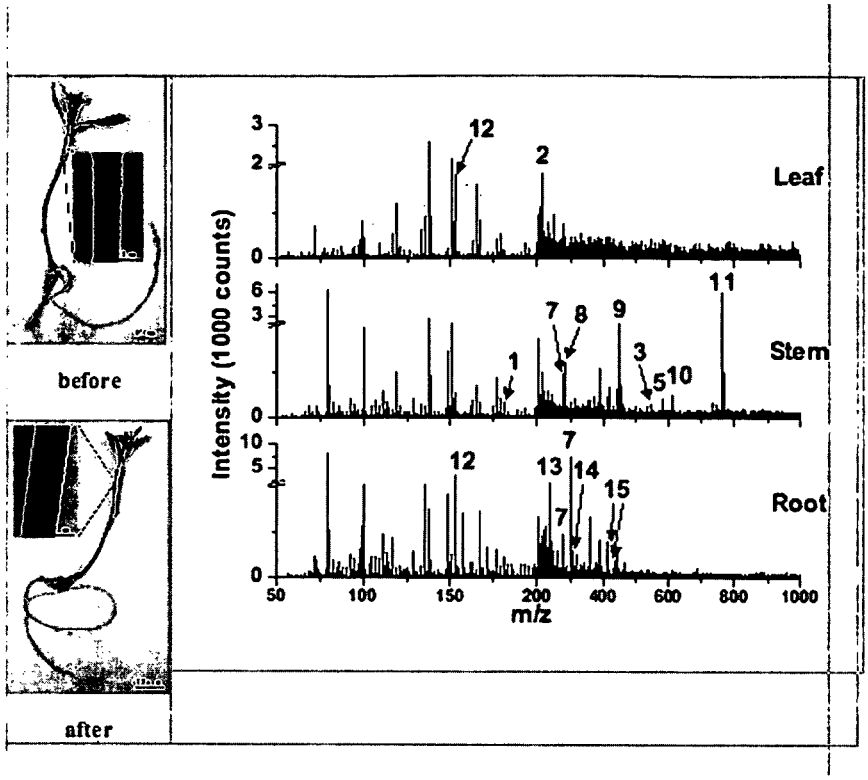
FIG. 4. In-vivo identification of metabolites in French marigold (*Tagetes patula*) seedling organs by LAESI-MS. (a) Single shot laser ablation of the leaf, the stem and the root of the plant produced mass spectra that included a variety of metabolites, some of them organ specific, detected at high abundances. Images of the analyzed area on the stem before and after the experiment showed superficial damage on a 350 μm diameter spot (see insets). (b) The signal for lower abundance species was enhanced by averaging 5 to 10 laser shots. The numbers in panels (a) and (b) correspond to the identified metabolites listed in Table 1.
Figure 4B:
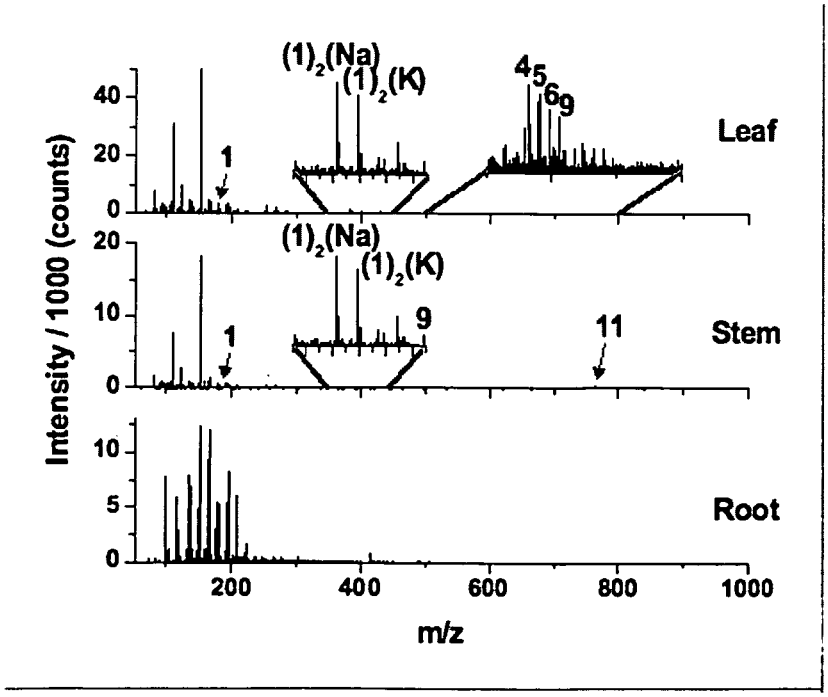

The LAESI provided herein allows one to study the spatial distribution of chemicals. In an example, a French marigold (*Tagetes patula*) plant in vivo from the leaf through the stem to the root, FIG. 4(*c*) was able to be chemically profiled.

Figure 8:
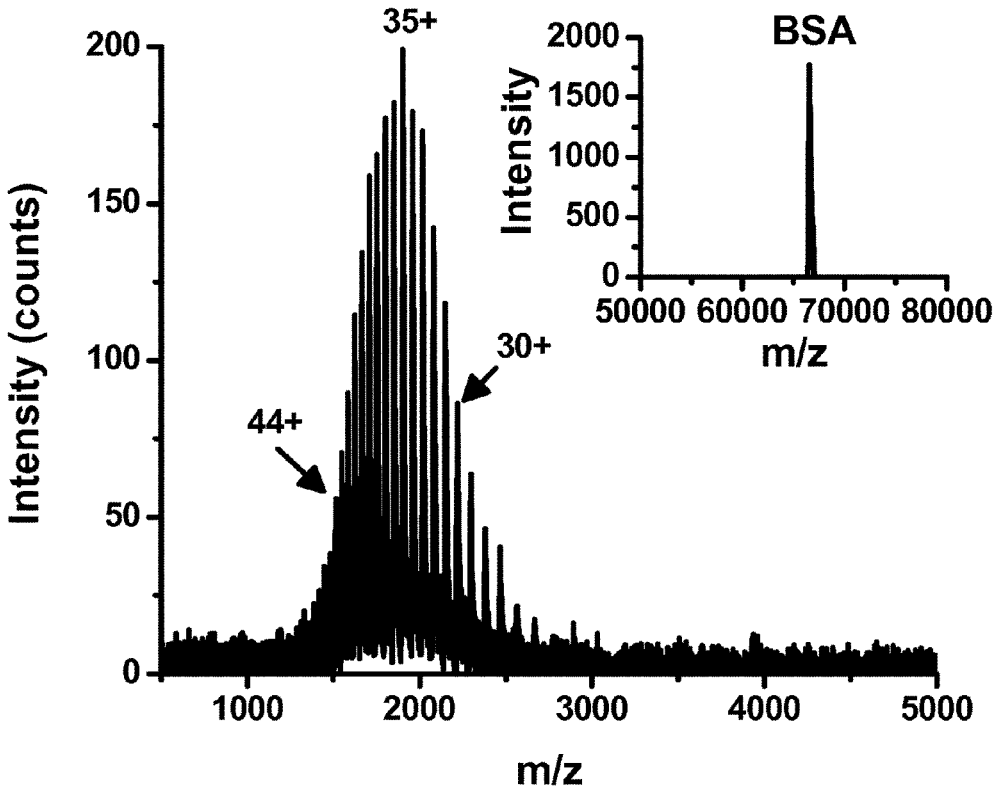
FIG. 8. In-vivo profiling of the plant French marigold (*Tagetes patula*) by LAESI-MS in positive ion mode. The mass spectra were recorded at different locations on the plant. Arrows show compounds specific to the leaf, stem and root of French marigold (*Tagetes patula*).

The LAESI provided herein achieves ESI-like ionization. Thus, large molecules can be detected as multiply charged species. This is shown for the case of bovine serum albumin, FIG. 8, which was directly ionized from glass substrate.

Figure 6:
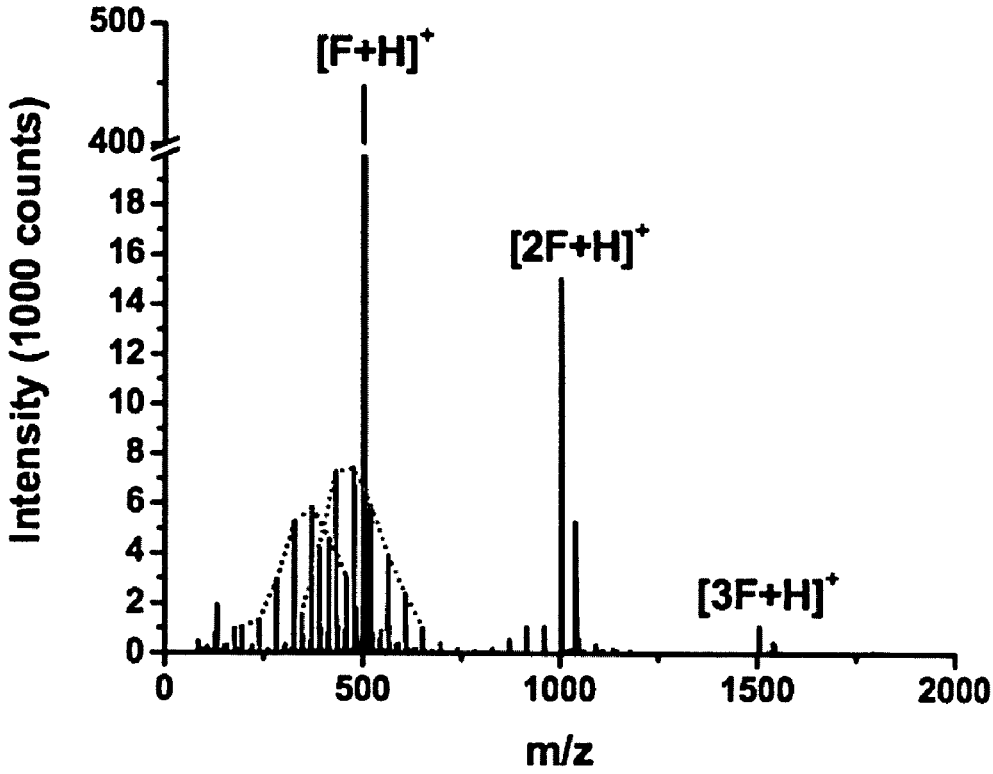
FIG. 6. (A) LAESI mass spectrum acquired in positive ion mode directly from a Telfast pill manufactured by Aventis Pharma Deutschland GmBH, Frankfurt am Main, Germany (similar to Allegra in the US). The active ingredient antihistamine, fexofenadine (F), was detected at high intensity as singly protonated monomer, dimer and trimer. Polyethylene glycol (PEG) 400 and its derivative were also identified during the analysis giving oligomer size distributions (short-dotted curves in black and gray). (B) Excretion of the antihistamine fexofenadine (FEX) studied by LAESI mass spectrometry. A 5 μL aliquot of the urine sample collected two hours after administering a Telfast caplet with 120 mg fexofenadine active ingredient was directly analyzed using LAESI-MS. Compared to the reference sample taken before administering the drug, the spectra revealed the presence of some new species (red ovals). Exact mass measurements on dissolved scrapings from a caplet core (see black inset) after drift compensation for reserpine (RES) showed m/z 502.2991 that corresponded to the elemental composition of protonated fexofenadine, $[C_{32}H_{39}NO_4+H]^+$, with a 7.5 ppm mass accuracy. Analysis of the caplet core by LAESI-MS (black inset) showed fragments of fexofenadine ($F_{FEX}$ and $F'_{FEX}$) and reserpine ($F_{RES}$ and $F'_{RES}$). A comparison of the spectra reveled that the other two new species observed in the urine sample were fragments of fexofenadine ($F_{FEX}$ and $F'_{FEX}$).
Figure 7:
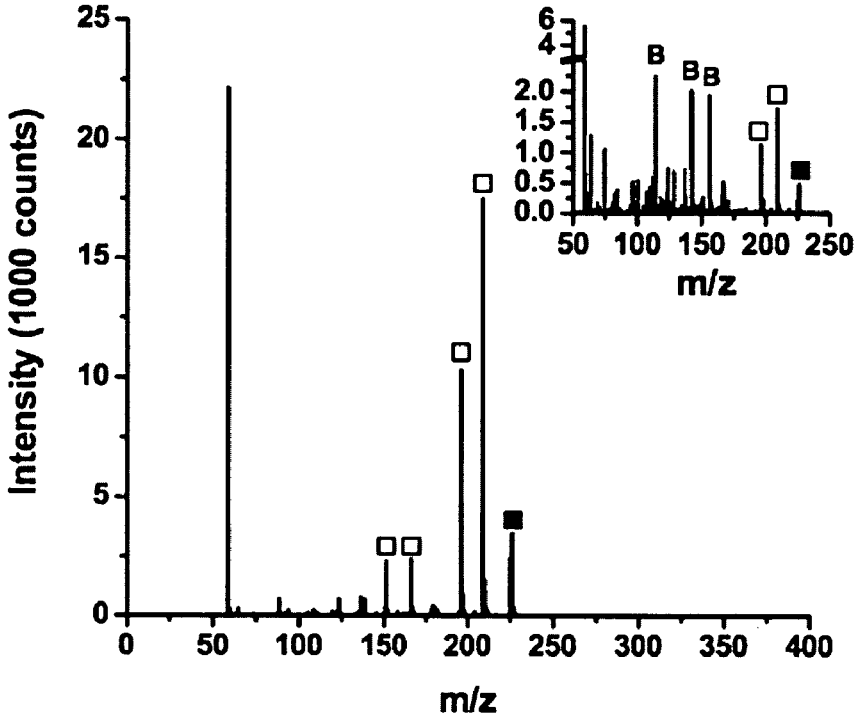
FIG. 7. Identification of explosives by LAESI-MS in negative ion mode. Dilute trinitrotoluene (TNT) solution was placed on a glass slide and detected by LAESI-MS (see spectrum). In a separate example, shown in the inset, a banknote contaminated with TNT was successfully analyzed. The solid square shows the molecular ion of TNT, whereas the open squares denote its fragments. Peaks labeled B arise from the ablation of the wetted banknote.

Also provided herein is the use of combined infrared laser ablation and electrospray ionization (ESI) as a novel ion source for mass spectrometry under ambient conditions. Demonstrated herein is the use of LAESI for the direct analysis of a variety of samples from diverse surfaces for small organic molecules, e.g., organic dyes, drug molecules FIG. 6, explosives FIG. 7, narcotics, and other chemicals of interest as described herein previously. Furthermore, the utility of the method for the direct analysis of synthetic polymers and biomolecules FIG. 4(*c*) from biological matrixes including tissues was shown. In vivo analysis of plan tissue was demonstrated. We confirmed that our technique enabled one to obtain intact molecular ions of proteins as large as 66 kDa (Bovine serum albumin) directly from biological samples without the need of sample preparation or other chemical pretreatment. One of the most significant applications of this ion source is in molecular imaging at atmospheric pressure.

Immediate uses are in biomedical analysis including in vivo studies, clinical analysis, chemical and biochemical imaging, drug discovery and other pharmaceutical applications, environmental monitoring, forensic analysis and homeland security.

The current version of LAESI achieves ionization from samples with a considerable absorption at ~3 μm wavelength. Thus, samples with significant water content are best suited for the technology. This limitation, however, can be mitigated by using lasers of different wavelengths and/or sprays of different composition.

EXPERIMENTAL

Materials

Laser ablation electrospray ionization. The electrospray system was identical to the one described in our previous study. Briefly, 50% methanol solution containing 0.1% (v/v) acetic was fed through a tapered tip metal emitter (100 μm i.d.

and 320 μm o.d., New Objective, Woburn, Mass.) using a low-noise syringe pump (Physio 22, Harvard Apparatus, Holliston, Mass.). Stable high voltage was directly applied to the emitter by a regulated power supply (PS350, Stanford Research Systems, Inc., Sunnyvale, Calif.). A flat polished stainless steel plate counter electrode (38.1 mm×38.1 mm×0.6 mm) with a 6.0-mm-diameter opening in the center was placed perpendicular to the axis of the emitter at a distance of 10 mm from the tip. This counter electrode was used to monitor the spray current with a digital oscilloscope (WaveSurfer 452, LcCroy, Chestnut Ridge, N.Y.). The temporal behavior of the spray current was analyzed to determine the established spraying mode. The flow rate and the spray voltage were adjusted to establish the cone-jet regime. The electrohydrodynamic behavior of the Taylor cone and the plume of ablated particulates were followed by a fast digital camera (QICAM, QImaging, Burnaby, BC, Canada) equipped with a long-distance microscope (KC, Infinity Photo-Optical Co., Boulder, Cob.). The cone and the generated droplets were back-illuminated with about 10 ns flash source based on fluorescence from a laser dye solution (Coumarin 540A, Exciton, Dayton, Ohio) excited by a nitrogen laser (VSL-337, Newport Corp., Irvine, Calif.).

The samples were mounted on microscope slides, positioned 10 to 30 mm below the spray axis and 3 to 5 mm ahead of the emitter tip, and ablated at a 90 degree incidence angle using an Er:YAG laser (Bioscope, Bioptic Lasersysteme AG, Berlin, Germany) at a wavelength of 2940 nm. The Q-switched laser source with a pulse length of <100 ns was operated at 5 Hz repetition rate with an average output energy of 3.5 ml/shot. Focusing was achieved by a single planoconvex $CaF_2$ lens (f=150 mm). Burn marks on a thermal paper (multigrade IV, Ilford Imaging Ltd., UK) indicated that the laser spot was circular with a diameter of 350-400 μm, and its size did not change appreciably by moving the target within ~20 mm around the focal distance. This corresponded to ~2.8-3.6 J/cm$^2$ laser fluence that could result in >60 MPa recoil stress buildup in the target.

The material expelled by the recoil stress in the laser ablation plume was intercepted by the electrospray plume operating in cone-jet mode and the generated ions were mass analyzed with a mass spectrometer (JMST100LC AccuTOF, JEOL Ltd., Peabody, Mass.). The data acquisition rate was set to 1 s/spectrum. The sampling cone of the mass spectrometer was in line with the spray axis. The ion optics settings were optimized for the analyte of interest, and were left unchanged during consecutive experiments. The LAESI system was shielded by a Faraday cage and a plastic enclosure to minimize the interference of electromagnetic fields and air currents, respectively. The enclosure also provided protection from the health hazards of the fine particulates generated in the laser ablation process.

To expose fresh areas during data acquisition, some of the samples were raster scanned by moving them in the X-Z plane in front of the laser beam using an X-Y-Z translation stage. Unless otherwise mentioned, the presented mass spectra were averaged over 5 seconds (25 laser shots). In general, single laser shots also gave sufficient signal-to-noise ratio in the mass spectra. The LAESI experiments were followed by microscope inspection and imaging of the ablation spots on the targets.

French marigold plant. French marigold (*Tagetes patula*) seeds were obtained from Fischer Scientific. Seedlings were grown in artificial medium in a germination chamber (model S79054, Fischer Scientific). Two seedlings were removed at 2 and 4 weeks of age, and were subjected to LAESI analysis without any chemical pretreatment. The roots of the plants were kept moist to avoid wilting during the studies. Following the experiment the plants were transplanted into soil and their growth was monitored for up to an additional four weeks to confirm viability.

Results

Postionization in Atmospheric Pressure Infrared Laser Ablation

Laser ablation of water-rich targets in the mid-infrared region (2.94 μm) has been utilized in medical (laser surgery) and analytical (AP IR-MALDI) applications. In these experiments laser energy is coupled into the target through the strong absorption band due to the OH vibrations. Ablation experiments on water, liver and skin revealed two partially overlapping phases. During the first ~1 μs, a dense plume develops as a consequence of surface evaporation and more importantly phase explosion in the target. This plume contains ions, neutrals and some particulate matter, and exhibits a shock front at the plume-air interface. Its expansion is slowed by the pressure of the background gas (air), thus it eventually comes to a halt and collapses back onto the target. The second phase is induced by the recoil pressure in the target and results in the ejection of mostly particulate matter. Depending on the laser fluence and target properties, this phase lasts for up to ~300 μs. Ultraviolet (UV) laser desorption studies on strongly absorbing targets in vacuum environment indicated that the degree of ionization in the plume was between $10^{-3}$ and $10^{-5}$. Laser ablation in the IR is likely to produce even lower ion yields due to the lower photon energies, typically lower absorption coefficients, and the copious ejection of neutral particulates. As a consequence the sensitivity in mass spectrometric applications suffers and the ion composition in the plume can be markedly different from the makeup of the target.

These problems can be alleviated by utilizing the neutral molecular species in the plume through post-ionization strategies. For example, at atmospheric pressure, applying a radioactive y emitter (e.g., a $^{63}$Ni foil) or chemical ionization through a corona discharge improved the ion yields for low-mass molecules. In a recent breakthrough, the ELDI method combined UV laser ablation with ESI. Significantly, ELDI did not exhibit discrimination against high mass analytes up to ~20 kDa.

Figure 1:
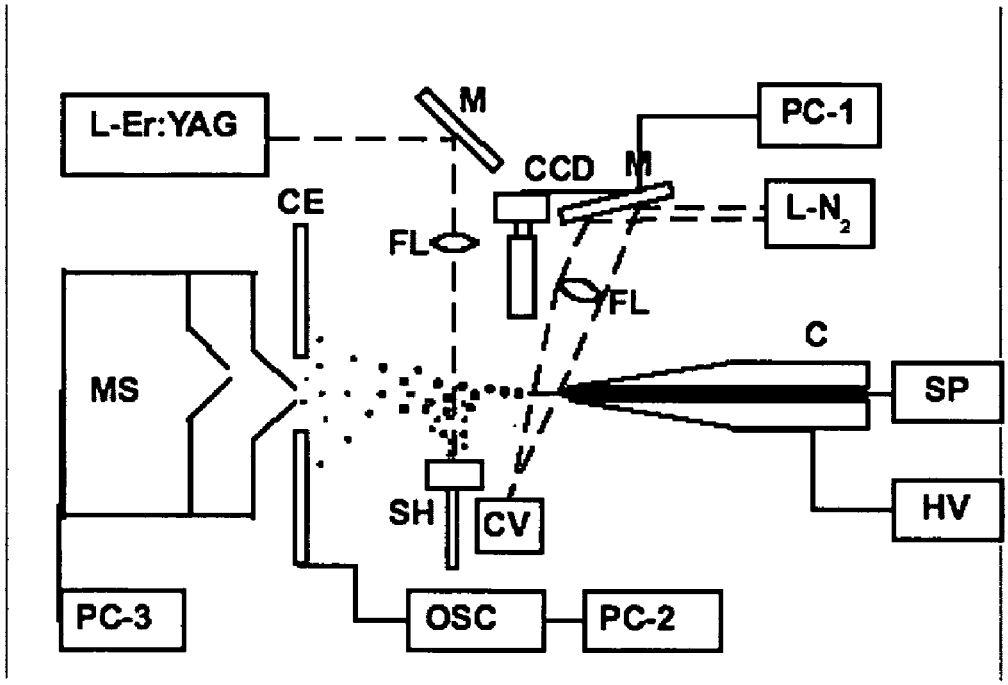
FIG. 1. Schematics of laser ablation electrospray ionization (LAESI) and fast imaging system (C capillary; SP syringe pump; HV high-voltage power supply; L-$N_2$ nitrogen laser; M mirrors; FL focusing lenses; CV cuvette; CCD CCD camera with short-distance microscope; CE counter electrode; OSC digital oscilloscope; SH sample holder; L-Er:YAG Er:YAG laser; MS mass spectrometer; PC-1 to PC-3 personal computers). Cone-jet regime is maintained through monitoring the spray current on CE and adjusting the spray parameters. Black dots represent the droplets formed by the electrospray. Their interaction with the particulates and neutrals (red dots) emerging from the laser ablation produces some fused particles (green dots) that are thought to be the basis of the LAESI signal.

Encouraged by the success of ELDI on pretreated and/or dehydrated samples, we sought to develop a new ionization technique for the analysis of untreated water-rich biological samples under ambient conditions. Similarly to AP IR-MALDI, in LAESI mid-IR laser ablation was used to produce a plume directly from the target. To post-ionize the neutrals and the particulate matter, this plume was intercepted under right angle by an electrospray operating in the cone-jet regime. FIG. 1 shows the schematics of the experimental arrangement. We chose the cone-jet spraying regime because of its exceptional ion yield and elevated duty cycle compared to other (e.g., burst or pulsating) modes of ESI operation. The sampling orifice of the mass spectrometer was in line with the spray axis. With the spray operating, laser ablation of targets absorbing in the mid-IR resulted in abundant ion signal over a wide range of m/z values. With no solution pumped through the electrified or floating emitter, no ions were detected during the experiments. Conversely, with the spray present but without laser ablation no ion signal was observed. Thus, a DESI-like scenario, or one involving chemical ionization through corona discharge at the emitter, did not play role in the ionization process. As we demonstrate after the discussion of concrete applications, LAESI also bears major differences from ELDI in both the range of its utility and probably in the details of ion production.

The figures of merit for LAESI were encouraging. The detection limit for reserpine and Verapamil analytes were ~100 fmol/sample (~0.1 fmol/ablated spot). Very importantly, quantitation showed linear response over four orders of magnitude with correlation coefficients of R>0.999 for both analytes. No ion suppression effect was observed. We successfully tested the use of LAESI on a variety of samples, including pharmaceuticals, small dye molecules, peptides, explosives, synthetic polymers, animal and plant tissues, etc., in both positive and negative ion modes. Here, we only present some of the examples most relevant in life sciences.

Antihistamine Excretion

Fexofenadine (molecular formula $C_{32}H_{39}NO_4$) is the active ingredient of various medications (e.g., Allegra® and Telfast®) for the treatment of histamine-related allergic reactions. This second-generation antihistamine does not readily enter the brain from the blood, and, it therefore causes less drowsiness than other remedies. To understand the pharmacokinetics of the active ingredient absorption, distribution, metabolism and excretion (ADME) studies are needed. For example, radiotracer investigations shown that fexofenadine was very poorly metabolized (only ~5% of the total oral dose), and the preferential route of excretion was through feces and urine (80% and 11%, respectively). This and other traditional methods (e.g., liquid chromatography with MS), however, are time consuming and require a great deal of sample preparation. As in the clinical stage of drug development it is common to encounter the need for the analysis of 1,000 to 10,000 samples, high throughput analysis is important. We tested whether LAESI was capable of rapidly detecting fexofenadine directly from urine without chemical pretreatment or separation.

Figure 2:
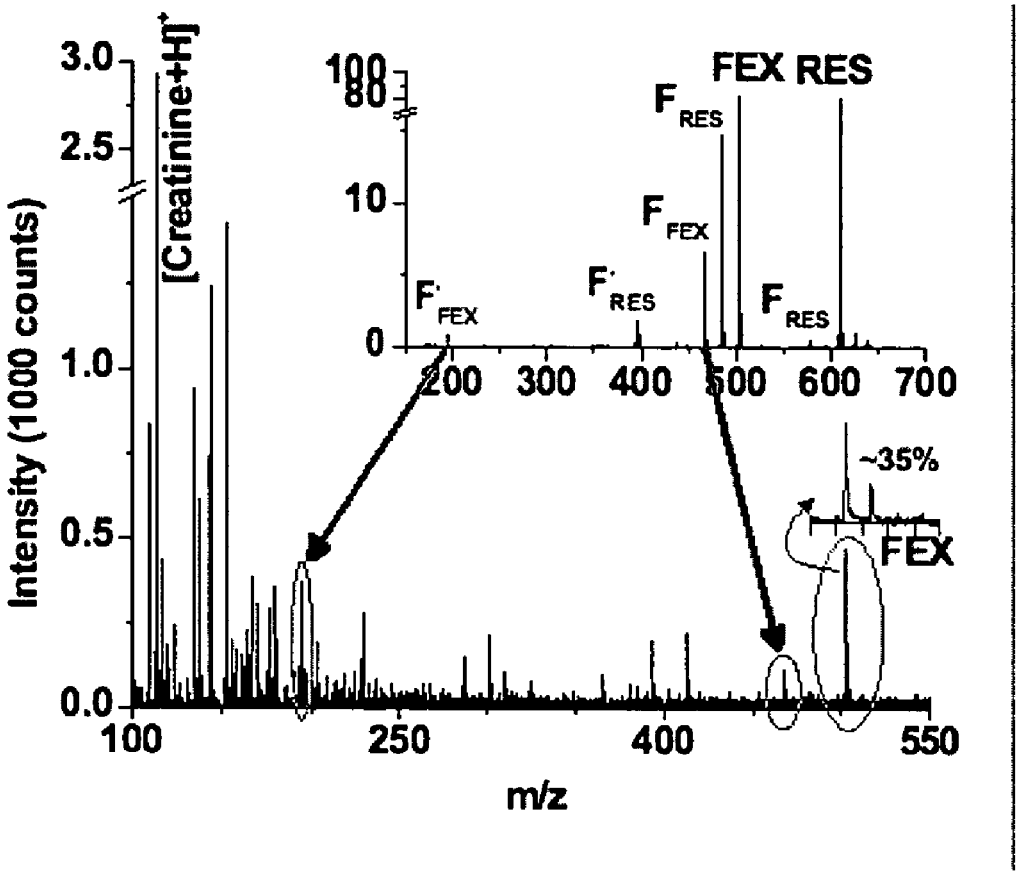
FIG. 2. Excretion of the antihistamine fexofenadine (FEX) studied by LAESI mass spectrometry. A 5 μL aliquot of the urine sample collected two hours after administering a Telfast caplet with 120 mg fexofenadine active ingredient was directly analyzed using LAESI-MS. Compared to the reference sample taken before administering the drug, the spectra revealed the presence of some new species (red ovals). Exact mass measurements on dissolved scrapings from a caplet core (see black inset) after drift compensation for reserpine (RES) showed m/z 502.2991 that corresponded to the elemental composition of protonated fexofenadine, $[C_{32}H_{39}NO_4+H]^+$, with a 7.5 ppm mass accuracy. Analysis of the caplet core by LAESI-MS (black inset) showed fragments of fexofenadine ($F_{FEX}$ and $F'_{FEX}$) and reserpine ($F_{RES}$ and $F'_{RES}$). A comparison of the spectra reveled that the other two new species observed in the urine sample were fragments of fexofenadine ($F_{FEX}$ and $F'_{FEX}$).

A Telfast® caplet with 120 mg of fexofenadine (FEX) was orally administered to a healthy volunteer. Urine samples were collected before and several times after ingestion. For all cases, a 5 μL aliquot of the untreated sample was uniformly spread on a microscope slide, and directly analyzed by LAESI-MS. A comparison made between the LAESI mass spectra showed that new spectral features appeared after drug administration. FIG. 2 shows the mass spectrum acquired two hours after ingestion. The peaks highlighted by red ovals correspond to the protonated form and the fragments of fexofenadine. Exact mass measurements indicated the presence of an ion with m/z 502.2991 that corresponded to the elemental composition $[C_{32}H_{39}NO_4+H]^+$ with a 7.5 ppm mass accuracy. The measured ~35% intensity at M+1 (see red inset) is consistent with the isotope abundances of this elemental composition. The mass spectra showed the presence of numerous other metabolites not related to the drug. For example, protonated ions of creatinine, the breakdown product of phosphocreatine, were very abundant. In future studies the other numerous metabolites present can be identified through, e.g., tandem MS, for broader metabolomics applications.

For reference, the caplet itself was also analyzed by LAESI (see black inset in FIG. 2). A small portion of the caplet core was dissolved in 50% methanol containing 0.1% acetic acid, and reserpine (RES) was added for exact mass measurements. The black inset in FIG. 2 shows that both the fexofenadine and the reserpine underwent in-source collision activated dissociation. In the black inset of FIG. 2, the resulting fragments are labeled as $F_{FEX}$, $F'_{FEX}$, $F_{RES}$ and $F'_{RES}$, respectively. A comparison of the urine and caplet spectra reveled that the other two new species observed in the urine sample were fragments of fexofenadine ($F_{FEX}$ and $F'_{FEX}$).

Due to the excellent quantitation capabilities of LAESI, the kinetics of fexofenadine excretion was easily followed. As no sample preparation is needed, the analysis time is limited by sample presentation (spotting on the target plate) and spectrum acquisition that for individual samples take ~5 s and ~0.05 s respectively. For high throughput applications the sample presentation time can be significantly reduced by sample holder arrays, e.g., 384-well plates, and robotic plate manipulation.

Whole Blood and Serum Samples

Due to the complexity of the sample, the chemical analysis of whole blood is a challenging task generally aided by separation techniques. Exceptions are the DESI and ELDI methods that have been shown to detect various molecules from moderately treated whole blood samples. In this example, we demonstrate that LAESI can detect metabolites and proteins directly from untreated whole blood samples.

Figure 3A:
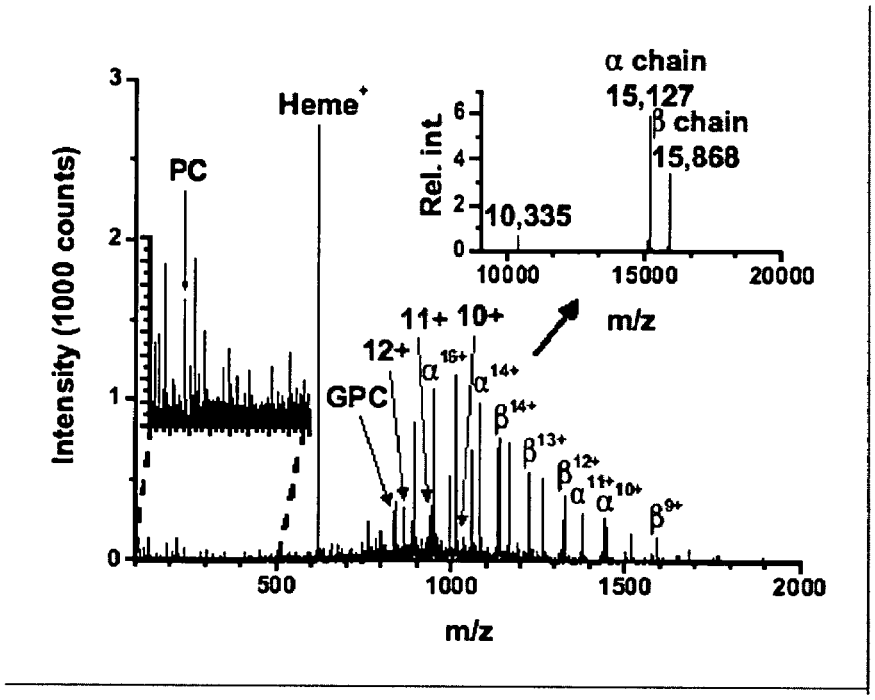
FIG. 3. LAESI-MS analysis of whole blood and serum. (a) LAESI-MS spectrum of whole blood without any pretreatment showed several singly and multiply charged metabolites in the low m/z (<1000 Da) region. For example, using exact mass measurements and human metabolome database search, phosphocholine (PC) (see the 20 enlarged segment of the spectrum) and glycerophosphocholines (GPC) were identified. The mass spectrum was dominated by the heme group of human hemoglobin ($Heme^+$). Deconvolution of the spectra of multiply charged ions (inset) in the higher m/z region identified the alpha and beta-chains of human hemoglobin with neutral masses of 15,127 Da and 15,868 Da, respectively. A protein with a neutral mass of 10,335 Da was also detected, likely corresponding to the circulating form of guanylin in human blood. (b) Human serum deficient of immunoglobulins in LAESI-MS experiments revealed several metabolites in the lower m/z region. Carnitine, phosphocholine (PC), tetradecenoylcarnitine (C14-carnitine) and glycerophosphocholines (GPC) were identified. Deconvolution of the multiply charged ions observed in the higher m/z region (see inset) identified human serum albumin (HSA) with a neutral mass of 66,556 Da.

Approximately 5 μL of whole blood was spread on a microscope slide and was directly analyzed by LAESI. In the mass spectra (see FIG. 3*a*) several singly and multiply charged metabolites were detected in the low m/z (<1000 Da) region. Using exact mass measurements and with the aid of a human metabolome database (available at http://www.hmdb.ca/), phosphocholine (PC, see the 20 enlarged segment of the spectrum) and glycerophosphocholines (GPC) were identified. The most abundant ion corresponded to the heme group of human hemoglobin. In the mid- to high m/z (>1000 Da) region a series of multiply charged ions were observed. Their deconvolution identified them as the α and β-chains of human hemoglobin with neutral masses of 15,127 Da and 15,868 Da, respectively (see the inset in FIG. 3*a*). A protein with a neutral mass of 10,335 Da was also detected, possibly corresponding to the circulating form of guanylin in human blood.

Figure 3B:
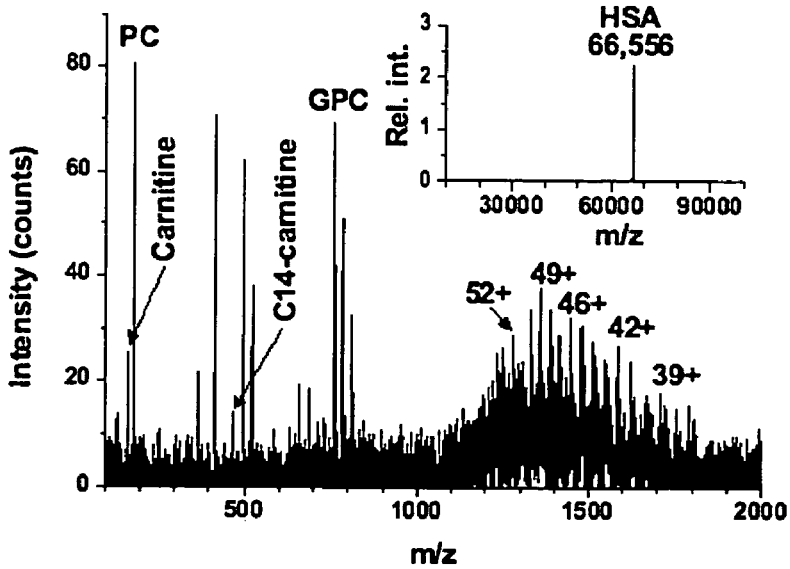

Lyophilized human serum, deficient in immunoglobulins, was reconstituted in deionized water and was subjected to LAESI-MS. The averaged spectrum is shown in FIG. 3*b*. Several metabolites were detected and identified in the lower m/z region, including carnitine, phosphocholine (PC), tetradecenoylcarnitine (C14-carnitine) and glycerophosphocholines (GPC). Based on molecular mass measurements alone, the structural isomers of GPCs cannot be distinguished. Using tandem mass spectrometry, however, many of these isomers and the additional species present in the spectrum can be identified. Similarly to the previous example, multiply charged ion distributions were also observed. By the deconvolution of the ions observed in the higher m/z region (see inset), we identified human serum albumin (HSA) with a neutral mass of 66,556 Da. These examples indicate that LAESI achieves ESI-like ionization without sample preparation, and extends the m/z range of the AP IR-MALDI technique.

In Vivo Profiling of a Petite French Marigold

Post ionization of the laser ablation plume provides LAESI with superior ionization efficiency over AP MALDI approaches. For example, we observed a ~$10^2$-$10^4$-fold enhancement in ion abundances compared to those reported for AP IR-MALDI. Higher sensitivity is most beneficial for in vivo studies that usually aim at the detection of low-concentration species with minimal or no damage to the organism. As an example we utilized LAESI for the in vivo profiling of metabolites in petite French marigold seedlings. The home-grown plants were placed on a microscope slide and single-laser shot analysis was performed on the leaf, stem and root of the plant to minimize the tissue damage.

The acquired mass spectra (see FIG. 4*a*) revealed various metabolites at high abundances. We identified some of these compounds in a two-step process. Due to the similarity of some metabolites for a diversity of plants, we first performed a search for the measured masses in the metabolomic database for *Arabidopsis thaliana* (available at http://www.arabidopsis.org/). Then the isotopic distributions of each ionic species were determined to support our findings and also to separate some isobaric species. The list of compounds was further extended by performing LAESI experiments, in which the mass spectra were averaged over ~5 to 10 consecutive laser shots (see FIG. 4*b*). Several additional compounds were detected, most likely due to the better signal-to-noise ratio provided by signal averaging.

By comparing the mass spectra obtained on the leaf, stem and root we found that certain metabolites were specific to the organs of the plant. The assigned compounds with the location of their occurrence and some of the related metabolic pathways are listed in Table 1. Consistent with the noncovalent hexose clusters in FIG. 4*b*, both the leaf and the stem had a high glucose and pigment content. However, different types of flavonoids were found in the leaf and the stem. The root primarily contained low-mass metabolites, e.g., saturated and unsaturated plant oils. These oils were also present in the other two organs of the plant. However, the root appeared to be rich in the saturated oils.

Compounds 9 and 11 were detected at surprisingly high abundances. For the latter, however, the database search gave no results. In-source CID experiments proved that 11 had relatively high stability, therefore the possibility of a noncovalent cluster was excluded. Exact mass measurements gave m/z 763.1671 with ~40% M+1 isotopic distribution, which corresponded to a $C_{39}H_{32}O_{15}Na^+$ elemental composition within 4 ppm mass accuracy. Although multiple structural isomers could correspond to the same chemical formula, based on previous reports in the literature on a flavonoid of identical mass, we assigned the compound as the sodiated form of kaempferol 3-O-(2", 3"-di-p-coumaroyl)-glucoside. Tandem MS results on extracts from the stem indicated the presence of several structural features consistent with this assignment. The presence of other kaempferol-derivatives in the plant can also be viewed as corroborative evidence.

After the analysis, microscope examination of the stem and the leaf revealed circular ablation marks of ~350 μm in diameter (see the insets in FIG. 4). This localized superficial damage had no influence on the life cycle of the seedling. We must emphasize however that due to the ablation by the laser LAESI is a destructive method, thus the size of the sampled area (currently 350-400 μm) needs to be considered as a limiting factor for in vivo experiments. Improvements can be achieved by reducing the size of the ablated areas or applying lower laser irradiances. As the current focusing lens has no correction for spherical aberration, significantly tighter focusing (and much less damage) can be achieved by using aspherical optics.

LAESI Mechanism

In the LAESI experiments surprisingly large target-to-spray distances (10 to 30 mm) provided the strongest signal. We also noticed that short distances (e.g., ~5 mm) led to the destabilization of the electrospray, resulting in a significant deterioration of the ion counts. Following the laser pulse, often material ejection was observed in the form of small particulates. The optimum distance of the ablation spot to the spray axis was established as ~25 mm, but appreciable ion abundances were still measured at 30 mm and beyond. As the area of the laser spot did not change noticeably within ~20 mm of the focal distance, the variations in LAESI signal were not related to differences in laser irradiance.

These observations in combination with fast imaging results on IR-laser ablation can provide some insight into the mechanism of LAESI. At similar laser fluences water and soft tissues first undergo non-equilibrium vaporization in the form of surface evaporation and to a much larger degree phase explosion. After ~1 μs, the expansion stops at a few millimeters from the surface and the plume collapses. Due to the recoil stress in the condensed phase, secondary material ejection follows in the form of particulates that can last up to several hundred microseconds. These particulates travel to larger distances than the initial plume. They are slowed and eventually stopped at tens of millimeters from the target by the drag force exerted on them by the resting background gas. The difference between the stopping distance of the primary plume and the recoil induced particle ejection can explain the difference between the optimum sampling distance for AP IR-MALDI (~2 mm) and LAESI (~25 mm).

Figure 5:
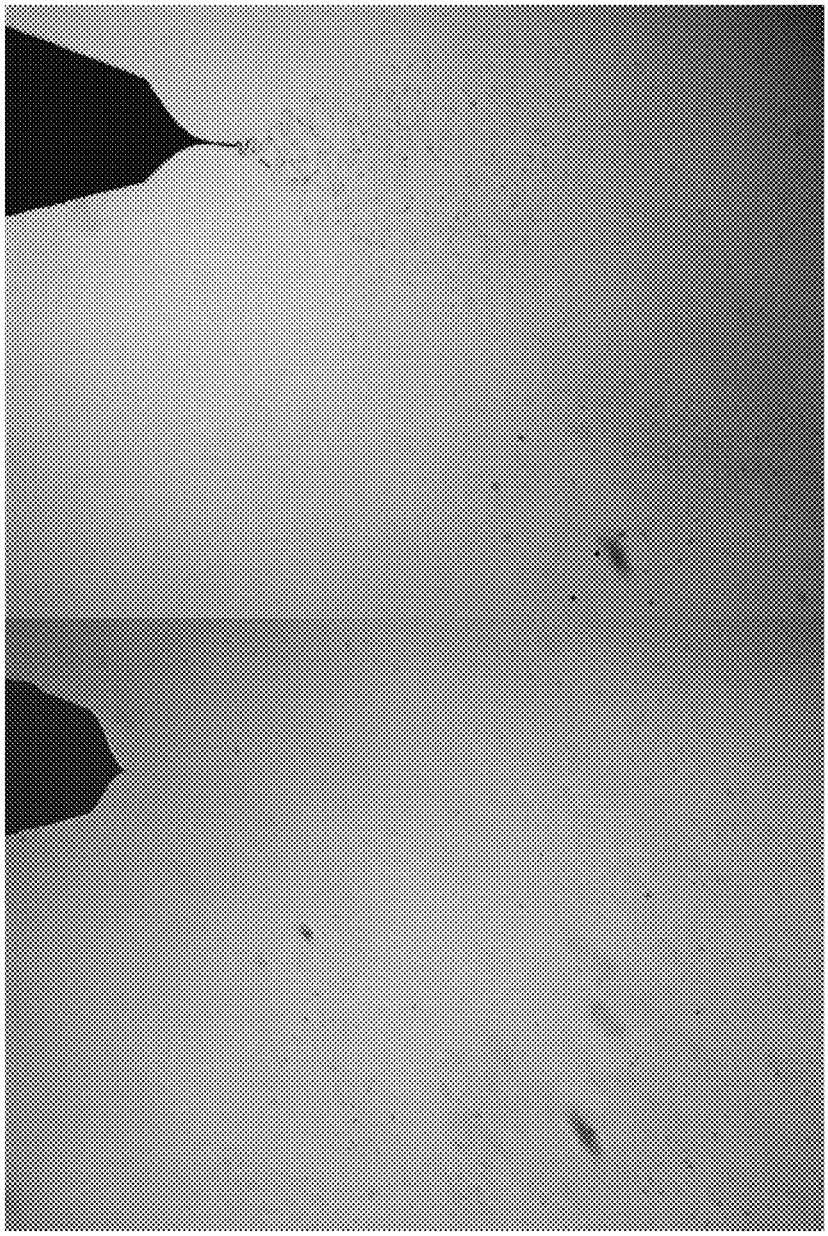
FIG. 5. Flash shadowgraphy with about 10 ns exposure time reveals the interaction between the electrospray (ES) plume and the laser ablation plume (LA) in a LAESI experiment. Pulsating spraying regime (top panel) offered lower duty cycle and larger ES droplets, whereas in cone-jet regime (bottom panel) the droplets were continuously generated and were too small to appear in the image. As the electrosprayed droplets traveled downstream from the emitter (from left to right), their trajectories were intercepted by the fine cloud of particulates (black spots in the images corresponding to 1 to 3 μm particles) traveling upward from the IR-ablation plume. At the intersection of the two plumes, some of the ablated particulates are thought to fuse with the ES droplets. The resulting charged droplets contain some of the ablated material and ultimately produce ions in an ESI process.

To confirm the interaction of the laser ablated particulates with the electrospray droplets in LAESI, fast imaging of the anticipated interaction region was carried out with ~10 ns exposure time. Upon infrared laser ablation of methanol solution target positioned 10 mm below and ~1 mm ahead of the emitter tip, a fine cloud consisting of particulates with sizes below 1 to 3 μm was produced and it was traveling vertically (from the bottom to the top in FIG. 5). These particulates were intercepted by the electrospray plume that evolved horizontally (from left to right) at the sampling height. In the pulsating mode (see the top panel of FIG. 5) the ES plume is clearly visible as it expands from the end of the filament in a conical pattern. The laser ablated particles are somewhat larger and enter from the bottom.

The image in the bottom panel shows the ES source operating in the cone-jet regime and producing much smaller droplets that are not resolved in the image. Here the larger laser ablated particles are clearly visible and are shown to travel through the region of the ES plume. Comparing the LAESI signal for pulsating and cone-jet ES regimes indicated that ion production was more efficient in the latter. These images suggest that the mechanism of ion formation in LAESI involves the fusion of laser ablated particulates with charged ES droplets. The combined droplets are thus seeded with the analytes from the target, retain their charge and continue their trajectory toward the mass spectrometer. Many of the ions produced from these droplets are derived from the analytes in the ablation target and exhibit the characteristics of ES ionization, e.g., multiply charged ions for peptides and proteins (see FIG. 3).

According to the fused-droplet hypothesis introduced for ELDI, a similar process is responsible for ion production in that method. In ELDI, however, a UV laser is used to perform desorption (as opposed to ablation) from the target with minimal surface damage. The presence of desorption in ELDI is also supported by the requirement for the relatively close proximity of the sample to the spray plume (3 mm) for sufficient ionization. In LAESI significantly larger amount of material is removed by the laser pulse. Analysis of ELDI and LAESI samples for the degree of laser damage after analysis could further clarify this distinction. Further differences stem from the operation of the ESI source. In ELDI there is no control over the spraying regime, whereas in LAESI the spray is operated in cone-jet mode.

DISCUSSION

Mid-infrared LAESI is a novel ambient mass spectrometric ion source for biological and medical samples and organisms with high water content. Beyond the benefits demonstrated in the Results section, it offers further, yet untested, possibilities. Unlike imaging with UV-MALDI, it does not require the introduction of an external matrix, thus the intricacies associated with the application of the matrix coating are avoided and no matrix effects are expected. By increasing the pulse energy of the ablating laser, it can be used to remove surface material and perform analysis at larger depths. Alternating between material removal and analysis can yield depth profile information. With improved focusing of the laser beam using aspherical or ultimately near-field optics, these manipulations can be made more precise and result in better spatial resolution. Reducing the size of the interrogated spot can open new possibilities with the eventual goal of subcellular analysis. These efforts have to be balanced by the sacrifices made in sensitivity due to the smaller amount of material available for analysis. Due to the efficiency of post-ionization in LAESI, however, the attainable minimum spot size is expected to be smaller than in, for example, AP IR-MALDI.

An inherent limitation of LAESI is its dependence on the water content of the sample. Thus tissues with lower mid-IR absorbances (e.g., dry skin, bone, nail and tooth) require significantly higher laser fluences to ablate. This effect is exaggerated by the higher tensile strength of these tissues that suppresses the recoil induced particle ejection. Furthermore, variations of water content and/or tensile strength in a sample can also lead to changes in LAESI ion yield and influence imaging results.

Based on our understanding of the LAESI mechanism, additional improvements in ion yield can be expected from enhancing the interaction between the laser ablation and the electrospray plumes. For example, tubular confinement of the ablation plume can make it more directed and increase its overlap with the electrospray. Adjusting the laser wavelength to other (CH or NH) absorption bands can introduce additional channels for laser energy deposition, thereby enabling the analysis of biological samples with low water content. The current and anticipated unique capabilities of LAESI promise to benefit the life sciences in metabolomic, screening and imaging applications including the possibility of in vivo studies.

Figure 9:
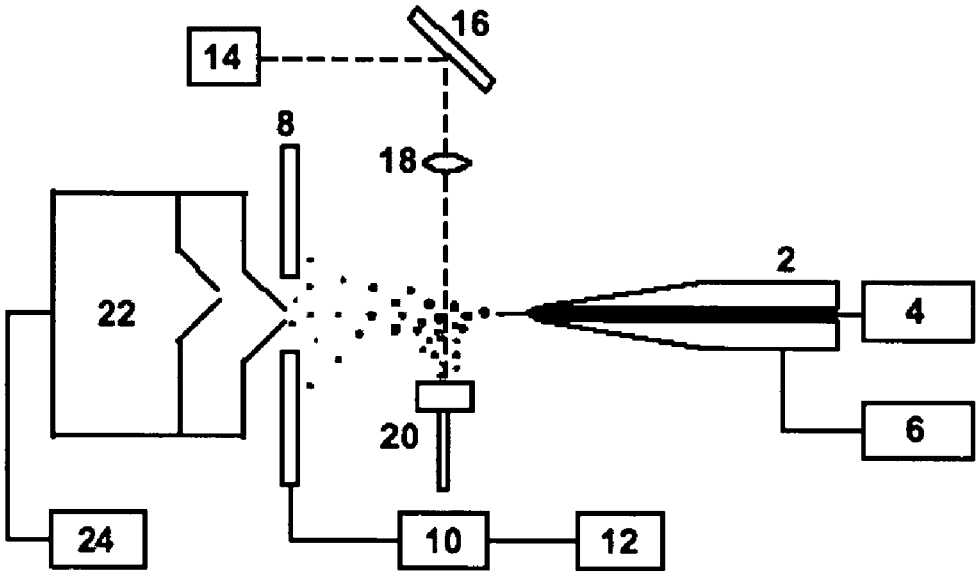
FIG. 9. LAESI schematics in Reflection Geometry. Component parts are indicated by reference number herein.
Figure 10:
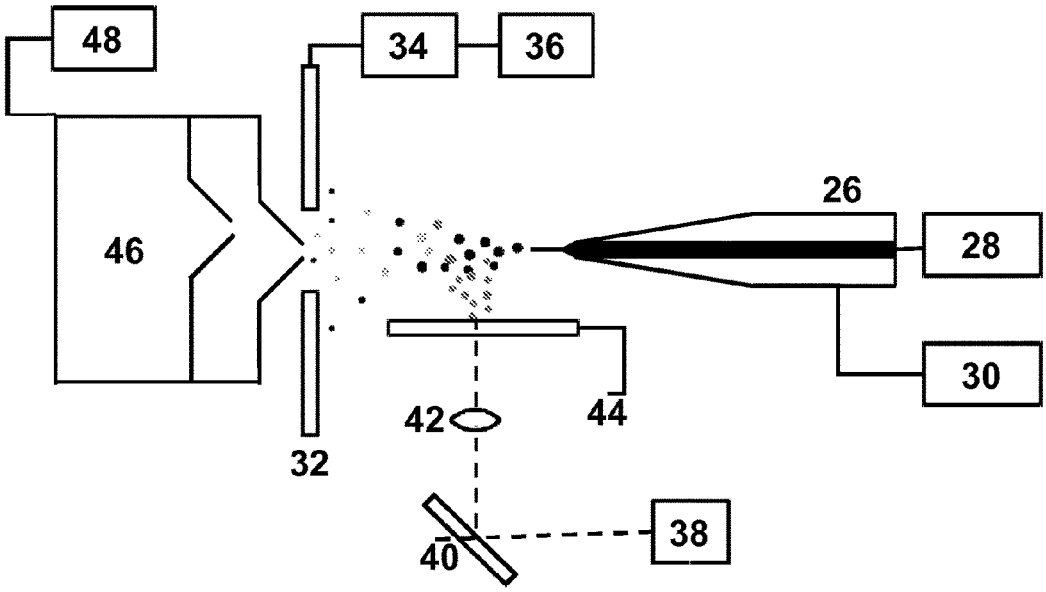
FIG. 10. Analysis of bovine serum albumin (BSA, Sigma-Aldrich) by LAESI-MS. The dried BSA sample was wetted prior to analysis. The mass analysis showed ESI-like charge state distribution ranging from 26+ to 47+ charges. The inset shows that deconvolution of the charge states gave a 66,547 Da for the molecular mass of BSA.

Referring to FIGS. 9 AND 10, schematics illustrate LAESI using Reflection Geometry FIG. 9 and LAESI using Transmission Geometry FIG. 10 with components labelled.

The components are provided in Table 2 below and are indicated by reference number.

TABLE 2

| FIG. 9: LAESI schematics in REFLECTION GEOMETRY |
|---|
| 2: electrospray capillary |
| 4: liquid supply with pump (this component is optional in the nanospray embodiment) |
| 6: high voltage power supply |
| 8: counter electrode |
| 10: oscilloscope |
| 12: recording device (e.g., personal computer) |
| 14: infrared laser (e.g., Er: YAG or Nd: YAG laser driven optical parametric oscillator) |
| 16: beam steering device (e.g., mirror) |
| 18: focusing device (e.g., lens or sharpened optical fiber) |
| 20: sample holder with x-y-z- positioning stage |
| 22: mass spectrometer |
| 24: recording device (e.g., personal computer) |
| FIG. 10: LAESI schematics in TRANSMISSION GEOMETRY |
| 26: electrospray capillary |
| 28: liquid supply with pump (this component is optional in the nanospray embodiment) |
| 30: high voltage power supply |
| 32: counter electrode |
| 34: oscilloscope |
| 36: recording device (e.g., personal computer) |
| 38: infrared laser (e.g., Er: YAG or Nd: YAG laser driven optical parametric oscillator) |
| 40: beam steering device (e.g., mirror) |
| 42: focusing device (e.g., lens or sharpened optical fiber) |
| 44: sample holder with x-y-z- positioning stage |
| 46: mass spectrometer |
| 48: recording device (e.g., personal computer) |

It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

TABLE 1

| # | Metabolite | Formula | Monoisotopic mass | Measured mass | Organ | Metabolic pathways |
|---|---|---|---|---|---|---|
| 1 | glucose | $C_6H_{12}O_6$ | 181.071 (H) | 181.019 (H) | leaf, stem | gluconeogenesis, glycolysis |
| 2 | 2-C-methyl-erythritol-4-phosphate | $C_5H_{13}O_7P$ | 217.048 (H) | 217.078 (H) | leaf | methylerythritol phosphate pathway |
| 3 | dTDP-4-dehydro-6-deoxy-glucose | $C_{16}H_{24}N_2O_{15}P_2$ | 547.073 (H) | 547.342 (H) | leaf | rhamnose biosynthesis |
| 4 | dTDP-glucose | $C_{16}H_{26}N_2O_{16}P_2$ | 565.084 (H) | 565.152 (H) | leaf | rhamnose biosynthesis |
| 5 | kaempferol-3-rhamnoside-7-rhamnoside | $C_{27}H_{30}O_{14}$ | 579.171 (H) | 579.173 (H) | leaf | flavonol biosynthesis |
| 6 | kaempferol 3-O-rhamnoside-7-O-glucoside | $C_{27}H_{30}O_{15}$ | 595.166 (H) | 595.171 (H) | leaf | flavonol biosynthesis |
| 7 | linolenic acid | $C_{18}H_{30}O_2$ | 279.232 (H)<br>301.214 (Na) | 279.153 (H)<br>301.131 (Na) | stem | fatty acid oxidation |
| 8 | cyanidin<br>luteolin, kaempferol | $C_{15}H_{11}O_6$<br>$C_{15}H_{10}O_6$ | 287.056 (+)<br>287.056 (H) | 287.055 (+)<br>287.055 (H) | stem | anthocyanin biosynthesis, flavanol biosynthesis |
| 9 | cyanidin-3-glucoside,<br>kaempferol-3-glucoside | $C_{21}H_{21}O_{11}$<br>$C_{21}H_{20}O_{11}$ | 449.108 (+)<br>449.108 (H) | 449.109 (+)<br>449.109 (H) | stem | anthocyanin biosynthesis, flavonol biosynthesis |

TABLE 1-continued

| # | Metabolite | Formula | Monoisotopic mass | Measured mass | Organ | Metabolic pathways |
|---|---|---|---|---|---|---|
| 10 | cyanidin-3,5-diglucoside, kaempferol 3,7-O-diglucoside | $C_{27}H_{31}O_{16}$<br>$C_{27}H_{30}O_{16}$ | 611.161 (+)<br>611.161 (H) | 611.163 (+)<br>611.163 (H) | stem | anthocyanin biosynthesis, flavonol biosynthesis |
| 11 | kaempferol 3-O-(2'', 3''-di-p-coumaroyl)-glucoside | $C_{39}H_{32}O_{15}$ | 763.164 (Na) | 763.167 (Na) | stem | — |
| 12 | methylsalicylate<br>xanthine | $C_8H_8O_3$<br>$C_5H_4N_4O_2$ | 153.055 (H)<br>153.041 (H) | 152.989 (H)<br>152.989 (H) | root | benzenoid ester biosynthesis, ureide degradation and synthesis |
| 13 | hydroxyflavone | $C_{15}H_{10}O_3$ | 239.071 (H) | 239.153 (H) | root | — |
| 14 | luteolin | $C_{15}H_{10}O_6$ | 309.038 (Na) | 309.194 (Na) | root | luteolin biosynthesis |
| 15 | phytosterols | $C_{29}H_{48}O$ | 413.378 (H)<br>435.360 (Na) | 413.259 (H)<br>435.074 (Na) | root | sterol biosynthesis |

What is claimed is:

1. An ambient ionization process comprising:

irradiating a sample having a water content in a native environment with a mid-infrared laser pulse to ablate the sample and generate an ablation plume;

intercepting the ablation plume with an electrospray to form gas-phase ions; and analyzing the ions using a mass spectrometer;

wherein the laser pulse has a laser energy that is coupled into the sample by the water in the sample; and wherein the laser pulse has a wavelength at an absorption band of an OH group.

2. The process of claim 1, wherein the sample is selected from the group consisting of pharmaceuticals, metabolites, dyes, explosives, narcotics, polymers, tissue samples, and large biomolecules, chemical warfare agents and their signatures, peptides, oligosaccharides, proteins, synthetic organics, drugs, explosives, and toxic chemicals.

3. The process of claim 1, wherein the sample is directly analyzed without an external matrix.

4. The process of claim 1, wherein the sample is directly analyzed without drying the sample.

5. The process of claim 1, wherein the sample is directly analyzed at atmospheric pressure.

* * * * *